US005620840A

United States Patent [19]

Maskasky

[11] Patent Number: 5,620,840

[45] **Date of Patent: *Apr. 15, 1997**

[54] HIGH BROMIDE TABULAR GRAIN EMULSIONS IMPROVED BY PEPTIZER SELECTION

[75] Inventor: Joe E. Maskasky, Rochester, N.Y.

[73] Assignee: Eastman Kodak Company, Rochester, N.Y.

[ * ] Notice: The term of this patent shall not extend beyond the expiration date of Pat. No. 5,604,085.

[21] Appl. No.: 643,225

[22] Filed: May 2, 1996

Related U.S. Application Data

[63] Continuation of Ser. No. 574,664, Dec. 19, 1995.

[51] Int. Cl.[6] ..... G03C 1/005

[52] U.S. Cl. ..... 430/567; 430/639; 430/641

[58] Field of Search ..... 430/567, 639, 430/641

[56] References Cited

U.S. PATENT DOCUMENTS

| | | | |
|---|---|---|---|
| 4,374,673 | 2/1983 | Aldrich | 106/212 |
| 4,400,463 | 8/1983 | Maskasky | 430/434 |
| 4,439,520 | 3/1984 | Kofron et al. | 430/434 |
| 4,713,320 | 12/1987 | Maskasky | 430/567 |
| 4,713,323 | 12/1987 | Maskasky | 430/569 |
| 4,717,650 | 1/1988 | Ikeda et al. | 430/567 |
| 5,287,744 | 2/1994 | Maskasky | 430/569 |
| 5,478,717 | 12/1995 | Ikeda et al. | 430/567 |
| 5,508,158 | 4/1996 | Yamashita et al. | 430/567 |

OTHER PUBLICATIONS

Mees *The Theory of the Photographic Process,* Revised Ed., Macmillan, 1951, pp. 48 and 49.

James *The Theory of the Photographic Process,* 4th Ed., Macmillan, 1977, p. 51.

"Photographic Silver Halide Emulsions, Preparations, Addenda, Systems and Processing", *Research Disclosure,* vol. 365, Sep. 1994, Item 36544.

"Photographic Silver Halide Emulsions, Preparations, Addenda, Processing and Systems", *Research Disclosure,* vol. 176, Dec. 1978, Item 17643.

*Primary Examiner*—Thorl Chea

*Attorney, Agent, or Firm*—Carl O. Thomas

[57] ABSTRACT

A high bromide tabular grain photographic emulsion is disclosed containing as a peptizer a water dispersible cationic starch.

13 Claims, No Drawings

HIGH BROMIDE TABULAR GRAIN EMULSIONS IMPROVED BY PEPTIZER SELECTION

This is a Continuation of application Ser. No. 08/574,664, filed Dec. 19, 1995, which claims priority from provisional patent application No. 60/001,579, filed Jul. 27, 1995.

FIELD OF THE INVENTION

The invention is directed to photographic emulsions. More specifically, the invention is directed to high bromide tabular grain emulsions containing selected peptizers.

BACKGROUND

Photographic emulsions are comprised of a dispersing medium and silver halide microcrystals, commonly referred to as grains. As the grains are precipitated from an aqueous medium, a peptizer, usually a hydrophilic colloid, is adsorbed to the grain surfaces to prevent the grains from agglomerating. Subsequently binder is added to the emulsion and, after coating, the emulsion is dried. The peptizer and binder are collectively referred to as the photographic vehicle of an emulsion.

Gelatin and gelatin derivatives form both the peptizer and the major portion of the remainder of the vehicle in the overwhelming majority of silver halide photographic elements. An appreciation of gelatin is provided by this description contained in Mees *The Theory of the Photographic Process,* Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommá of certain animal refuse." The process of glue making is age-old and consists essentially in boiling down hide clippings or ones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling constituents of glue are not present in gelatin. Glue is thus distinguished by its adhesive properties; gelatin by its cohesive properties, which favor the formation of strong jellies.
>
> Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 percent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.
>
> Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process,* 4th Ed., Macmillan, 1977, p. 51, states:

> Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure,* Vol. 365, Sept. 1994, Item 36544, II. Vehicles, vehicle extenders, vehicle-like addenda and vehicle related addenda, A. Gelatin and hydrophilic colloid peptizers, paragraph (1) states:

> (1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like . . .

This description is identical to that contained in *Research Disclosure,* Vol. 176, December 1978, Item 17643, IX. Vehicles and vehicle extenders, paragraph A. *Research Disclosure* is published by Kenneth Mason Publications, Ltd., Dudley House, 12 North St., Emsworth, Hampshire P010 7DQ, England.

During the 1980's a marked advance took place in silver halide photography based on the discovery that a wide range of photographic advantages, such as improved speed-granularity relationships, increased covering power, both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected high (>50 mole %) bromide tabular grain populations in photographic emulsions.

In descriptions of these emulsions, as illustrated by Kofron et al U.S. Pat. No. 4,439,520, the vehicle disclosure of *Research Disclosure* Item 17643 was incorporated verbatim. Only gelatin peptizers were actually demonstrated in the Examples.

Despite the assumption that conventional vehicle selections are fully applicable to tabular grain emulsions, there have been some indications that some peptizer selections are particularly advantageous for tabular grain emulsions. Maskasky U.S. Pat. No. 4,400,463 disclosed the use of synthetic peptizers in combination with adenine to produce high (>50 mole %) chloride tabular emulsions. Later Maskasky U.S. Pat. Nos. 4,713,320 and 4,713,323 demonstrated that high bromide and high chloride tabular grain emulsions could be improved by treating gelatin with an oxidizing agent.

Maskasky U.S. Pat. No. 5,284,744 taught the use of potato starch as a peptizer for the preparation of cubic grain silver halide emulsions, noting that potato starch has a lower absorption, compared to gelatin, in the wavelength region of from 200 to 400 nm. Maskasky '744 does not disclose tabular grain emulsions.

RELATED APPLICATIONS

Maskasky U.S. Ser. No. 08/574,833, filed Dec. 19, 1995, now allowed and commonly assigned, titled HIGH BROMIDE TABULAR GRAIN EMULSIONS IMPROVED BY PEPTIZER SELECTION, is directed to an improved spectrally sensitized ultrathin tabular grain emulsion in which tabular grains (a) having {111} major faces, (b) containing greater than 50 mole percent bromide, based on silver, (c) accounting for greater than 70 percent of total grain projected area, (d) exhibiting an average equivalent circular diameter of at least 0.7 μm, and (e) exhibiting an average thickness of less than 0.07 μm, show an enhanced capability for chemical sensitization by reason of employing a cationic starch as a peptizer.

A photographic element is disclosed comprised of a support, a first silver halide emulsion layer coated on the support and sensitized to produce a photographic record when exposed to specular light within the minus blue visible wavelength region of from 500 to 700 nm, a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of the improved spectrally sensitized ultrathin tabular grain emulsion of the invention.

Maskasky U.S. Ser. No. 08/574,834, filed Dec. 19, 1995, commonly assigned, titled PHOTOGRAPHIC EMULSIONS IMPROVED BY PEPTIZER MODIFICATION, is directed to radiation-sensitive silver halide emulsions containing an oxidized cationic starch as a peptizer.

Maskasky U.S. Ser. No. 08/574,489, filed Dec. 19, 1995, commonly assigned, titled HIGH BROMIDE ULTRATHIN TABULAR GRAIN EMULSIONS IMPROVED BY PEPTIZER MODIFICATION, is directed to an improved spectrally sensitized ultrathin tabular grain emulsion in which tabular grains (a) having {111} major faces, (b) containing greater than 50 mole percent bromide, based on silver, (c) accounting for greater than 70 percent of total grain projected area, (d) exhibiting an average equivalent circular diameter of at least 0.7 mm, and (e) exhibiting an average thickness of less than 0.07 μm, show an enhanced capability for chemical sensitization by reason of employing an oxidized cationic starch as a peptizer.

SUMMARY OF THE INVENTION

In one aspect this invention is directed to a radiation-sensitive emulsion comprised of silver halide grains including tabular grains (a) having {111} major faces, (b) containing greater than 50 mole percent bromide, based on silver, (c) accounting for greater than 50 percent of total grain projected area, and (d) having a thickness in the range of from at least 0.07 to 0.3 μm, and a dispersing medium including a peptizer adsorbed to the silver halide grains, wherein the peptizer is a water dispersible cationic starch.

It has been discovered quite surprisingly that cationic starches are better suited for preparing high bromide {111} tabular grain emulsions than non-cationic starches and that cationic starches, when present in place of gelatin, facilitate photographic advantages.

Cationic starches exhibit lower levels of viscosity than have previously been present in preparing tabular grain emulsions. Reduced viscosity facilitates more uniform mixing. Both micromixing, which controls the uniformity of grain composition, mean grain size and dispersity, and bulk mixing, which controls scale up of precipitations to convenient manufacturing scales, are favorably influenced by the reduced viscosities made possible by cationic starch peptizers. Precise control over grain nucleation, including the monodispersity of the grain nuclei, is particularly important to successfully achieving and improving the properties of tabular grain emulsions.

Under comparable levels of chemical sensitization higher photographic speeds can be realized with cationic starches. Alternatively, lower temperatures can be employed during chemical sensitization of cationic starch peptized tabular grain emulsions to achieve photographic speeds equal or superior to those of gelatino-peptized emulsions. Lower temperatures have the advantage of protecting the emulsions of protecting the tabular grains from unwanted ripening during chemical sensitization.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabularity" is defined as $ECD/t^2$, where ECD and t are both measured in micrometers (μm).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "high bromide" or "high chloride" in referring to grains and emulsions indicates that bromide or chloride, respectively, are present in concentrations of greater than 50 mole percent, based on total silver.

In referring to grains and emulsions containing two or more halides, the halides are named in order of ascending concentrations.

The term "{111} tabular" is employed in referring to tabular grains and tabular grain emulsions in which the tabular grains have {111} major faces.

The term "gelatino-peptizer" is employed to designate gelatin and gelatin-derived peptizers.

The terms "selected cationic starch peptizer" and "selected peptizer" are employed to designate a water dispersible cationic starch.

The term "cationic" in referring to starch indicates that the starch molecule has a net positive charge at the pH of intended use.

The term "water dispersible" in referring to cationic starches indicates that, after boiling the cationic starch in water for 30 minutes, the water contains, dispersed to at least a colloidal level, at least 1.0 percent by weight of the total cationic starch.

The term "middle chalcogen" designates sulfur, selenium and/or tellurium.

DESCRIPTION OF PREFERRED EMBODIMENTS

The present invention is generally applicable to high bromide {111} tabular grain emulsions. That is, greater than 50 percent of total grain projected area is accounted for by tabular grains having {111} major faces, and the tabular grains contain greater than 50 mole percent bromide, based on silver.

The emulsions of tie present invention can be readily distinguished from conventional high bromide {111} tabular grain emulsions in that a water dispersible cationic starch is adsorbed to the grain surfaces, thereby acting as a peptizer. Any conventional water dispersible cationic starch can be employed as a peptizer.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch or high amylose corn starch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

(I)

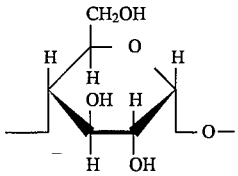

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
Barber et al U.S. Pat. No. 3,219,518;
Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
Dishburger et al U.S. Pat. No. 3,467,608;
Beaninga et al U.S. Pat. No. 3,467,647;

Brown et al U.S. Pat. No. 3,671,310;
Cescato U.S. Pat. No. 3,706,584;
Jarowenko et al U.S. Pat. No. 3,737,370;
Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
Tsai et al U.S. Pat. No. 5,227,481; and
Tsai et al U.S. Pat. No. 5,349,089.

The water dispersible cationic starch is present during the precipitation (during nucleation and grain growth or during grain growth) of the high bromide {111} tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, here incorporated by reference, are specifically contemplated to be useful in the practice of the invention, subject to the selected peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitouet al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Charfee et al U.S. Pat. No. 5,358,840; and
Delton U.S. Pat. No. 5,372,927.

The high bromide {111} tabular grain emulsions that are formed preferably contain at least 70 mole percent bromide and optimally at least 90 mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent. It is generally preferred that the iodide concentration be less than 20 mole percent. Significant photographic advantages can be realized with iodide concentrations as low as 0.5 mole percent, with an iodide concentration of at least 1 mole percent being preferred.

The high bromide {111} tabular grain emulsions can exhibit mean grain ECD's of any conventional value, ranging up to 10 μm, which is generally accepted as the maximum mean grain size compatible with photographic utility. In practice, the tabular grain emulsions of the invention typically exhibit a mean ECD in the range of from about 0.2 to 5.0 μm. Tabular grain thicknesses in the emulsions of this invention range from at least 0.07 μm to 0.3 μm. For blue recording somewhat thicker grains, up to about 0.5 μm, can be employed. For minus blue (red and/or green) recording, thin (<0.2 μm) tabular grains are preferred.

Ultrathin (<0.07 μm) tabular grains, the subject matter of U.S. Ser. No. 08/574,833, cited above, are specifically preferred for most minus blue recording in photographic elements forming dye images (i.e., color photographic elements). An important distinction between ultrathin tabular grains and those having greater (≧0.07 μm) thicknesses resides in the difference in their reflective properties. Ultrathin tabular grains exhibit little variation in reflection as a function of the wavelength of visible light to which they are exposed, where as thicker tabular grains exhibit pronounced reflection maxima and minima as a function of the wavelength of light. Hence ultrathin tabular grains simplify construction of photographic element intended to form plural color records (i.e., color photographic elements). This property, together with the more efficient utilization of silver attributable to ultrathin grains, provides a strong incentive for their use in color photographic elements.

On the other hand, otherwise comparable tabular grain emulsions used to form silver images differing in tabular grain thickness produce colder image tones on processing as tabular grain thickness is increased. Colder image tones are sought particularly in radiographic images, but they are also sought in variety of black-and-white photography applications..

Except for the wavelength dependence of reflectance and image tone, noted above, the advantages that tabular grains impart to emulsions generally increases as the average aspect ratio or tabularity of the tabular grain emulsions increases. Both aspect ratio (ECD/t) and tabularity (ECD/$t^2$) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 μm (preferably less than 0.2 μm and optimally less than 0.07 μm) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred.

Conventional dopants can be incorporated into the tabular grains during their precipitation, as illustrated by the patents cited above and *Research Disclosure,* Item 36544, cited above, Section I. Emulsion grains and their preparation, D. Grain modifying conditions and adjustments, paragraphs (3), (4) and (5). It is specifically contemplated to incorporate shallow electron trapping site providing (SET) dopants in the tabular grains as disclosed in *Research Disclosure,* vol. 367, November 1994, Item 36736.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501, cited above and here incorporated by reference. In a specifically preferred form high chloride silver halide epitaxy is present at the edges or, most preferably, restricted to corner adjacent sites on the tabular grains.

Although epitaxy onto the host tabular grains can itself act as a sensitizer, the emulsions of the invention show unexpected sensitivity enhancements with or without epitaxy when chemically sensitized in the absence of a gelatino-peptizer, employing one or a combination of noble metal, middle chalcogen and reduction chemical sensitization techniques. Conventional chemical sensitizations by these techniques are summarized in *Research Disclosure,* Item 36544, cited above, Section IV. Chemical sensitizations. All of these sensitizations, except those that specifically require the presence of gelatin (e.g., active gelatin sensitization) are applicable to the practice of the invention. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

(II)

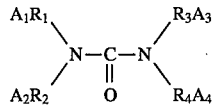

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(III)}$$

wherein

L is a mesoionic compound;

X is an anion; and $L^1$ is a Lewis acid donor.

In another preferred form of the invention it is contemplated to employ alone or in combination with sulfur sensitizers, such as those formula II, and/or gold sensitizers, such as those of formula III, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

Preferred 2-[N-(2-alkynyl)amino]-meta-chalcoazoles can be represented by the formula:

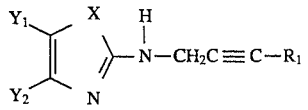

(IV)

where

X=O, S, Se;

$R_1$=(IVa) hydrogen or (IVb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula IV compounds are generally effective (with the IVb form giving very large speed gains and exceptional latent image stability) when present during the heating step (finish) that results in chemical sensitization.

Spectral sensitization of the emulsions of the invention is not required, but is highly preferred, even when photographic use of the emulsion is undertaken in a spectral region in which the tabular grains exhibit significant native sensitivity. While spectral sensitization is most commonly undertaken after chemical sensitization, spectral sensitizing dye can be advantageous introduced earlier, up to and including prior to grain nucleation. Kofron et al discloses advantages for "dye in the finish" sensitizations, which are those that introduce the spectral sensitizing dye into the emulsion prior to the heating step (finish) that results in chemical sensitization. Maskasky U.S. Pat. No. 4,435,501 teaches the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogous that exhibit absorption maxima in the green and red portions of the spectrum, are particularly preferred for incorporation in the tabular grain emulsions of the invention. A more general summary of useful spectral sensitizing dyes is provided by *Research Disclosure,* Item 36544, cited above, Section V. Spectral sensitization and desensitization.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

At any time following chemical sensitization and prior to coating additional vehicle is added to the emulsions of the invention. Conventional vehicles and related emulsion components are illustrated by *Research Disclosure,* Item 36544, cited above, Section II. Vehicles, vehicle extenders, vehicle-like addenda and vehicle related addenda.

Aside from the features described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure,* Item 36544, Section I. Emulsion grains and their preparation, E. Blends, layers and performance categories. Other common, but optional features are illustrated by *Research Disclosure,* Item 36544, Section VII, Antifoggants and stabilizers; Section VIII, Absorbing and scattering materials; Section IX, Coating physical property modifying agents; Section X, Dye image formers and modifiers. The features of Sections II and VII–X can alternatively be provided in other photographic element layers.

The photographic applications of the emulsions of the invention can encompass other conventional features, such as those illustrated by *Research Disclosure,* Item 36544, Sections:

XI. Layers and layer arrangements

XII. Features applicable only to color negative

XIII. Features applicable only to color positive

XIV. Scan facilitating features

XV. Supports

XVI. Exposure

XVII. Physical development systems

XVIII. Chemical development systems

XIX. Development

XX. Desilvering, washing, rinsing and stabilizing (post-development)

EXAMPLES

The invention can be better appreciated by reference to the following specific examples. Except as otherwise indicated all weight percentages (wt %) are based on total weight.

EXAMPLES 1 THROUGH 17

These examples demonstrate the precipitation of tabular grain emulsions using a cationic starch derived from different plant sources, including a variety of potato and grain sources. The starches were selected to demonstrate a wide range of nitrogen and phosphorus contents. Variations in emulsion precipitation conditions are also demonstrated. Particularly significant is the demonstration that all of the cationic starch used for the entire precipitation can be added prior to grain nucleation.

EXAMPLE 1

AgIBr (3 mole % I) Tabular Grain Emulsion Made Using a Cationic Potato Starch

A starch solution was prepared by boiling for 30 min a stirred mixture of 80 g cationic potato starch (STA-LOK® 400, obtained from A. E. Staley Manufacturing Co., Decatur, Ill.), 27 mmoles of NaBr, and distilled water to 4 L. The cationic starch was a mixture of 21% amylose and 79% amylopectin and contained 0.33 wt % nitrogen in the form of a quaternary trimethyl ammonium alkyl starch ether and 0.13 wt % natural phosphorus. The cationic starch had an average molecular weight is 2.2 million. The resulting solution was cooled to 35° C., readjusted to 4 L with distilled water, and the pH was adjusted to 5.5. To a vigorously stirred reaction vessel of the starch solution at 35° C., a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 50 mL per min in 30 min until a total of 1.00 L had been added. The salt solution was concurrently added at a rate needed to maintain a constant pBr of 1.76. The resulting tabular grain emulsion was washed by diafiltration at 40° C. to a pBr of 3.38.

The tabular grain population of the resulting tabular grain emulsion was comprised of tabular grains with an average equivalent circular diameter of 1.2 μm, an average thickness of 0.06 μm, and an average aspect ratio of 20. The tabular grain population made up 92% of the total projected area of the emulsion grains. The emulsion grains had a coefficient of variation in diameter of 18%.

EXAMPLE 2

AgIBr (3 mole % I) Tabular Grain Emulsion Made Using a Cationic Corn Starch

A starch solution was prepared by boiling for 30 min a stirred 400 g aqueous mixture containing 2.7 mmoles of NaBr and 8.0 g of a cationic hybrid corn starch (CATO® 235, obtained from National Starch and Chemical Company, Bridgewater, N.J.) containing 0.31 wt % nitrogen and 0.00 wt % phosphorus.

The resulting solution was cooled to 35° C., readjusted to 400 g with distilled water. To a vigorously stirred reaction vessel of the starch solution at 35° C., pH 5.5 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the $AgNO_3$ solution was added at 1.0 mL per min for 1 min then its addition rate was accelerated to reach a flow rate of 5 mL per min in 30 min until a total of 100 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.6 μm, an average thickness of 0.06 μm, and an average aspect ratio of 27. The tabular grain population made up 85% of the total projected area of the emulsion grains.

EXAMPLE 3

AgIBr (3 mole % I) Tabular Grain Emulsion Made Using a Cationic Amphoteric Potato Starch This emulsion was prepared similarly to Example 2, except that the starch used was a cationic amphoteric potato starch (Wespol A®, obtained from Western Polymer Corporation, Moses Lake, Wash.) containing both a quaternary trimethyl ammonium alkyl starch ether, 0.36 wt % nitrogen, and orthophosphate (0.70 wt % phosphorous) substituents.

The tabular grain population of the resulting emulsion was comprised of tabular grains with an average equivalent circular diameter of 1.7 μm, an average thickness of 0.05 μm, and an average aspect ratio of 34. The tabular grain population made up 95% of the total projected area of the emulsion grains.

EXAMPLE 4

AgIBr (3 mole % I) Tabular Grain Emulsion Made Using a Cationic Amphoteric Potato Starch This emulsion was prepared similarly to Example 3, except that the precipitation was stopped after 50 mL of the $AgNO_3$ solution was added.

The tabular grain population of the resulting emulsion was comprised of tabular grains with an average equivalent circular diameter of 1.0 μm, an average thickness of 0.045 μm, and an average aspect ratio of 25. The tabular grain population made up 95% of the total projected area of the emulsion grains.

EXAMPLE 5

AgIBr (3 mole % I) Tabular Grain Emulsion Made Using a Cationic Potato Starch and at pH 2.0

This emulsion was prepared similarly to Example 2, except that the emulsion was precipitated at pH 2.0 and the starch used was cationic potato starch (STA-LOK® 400).

The tabular grain population of the resulting emulsion was comprised of tabular grains with an average equivalent circular diameter of 1.5 μm, an average thickness of 0.06 μm, and an average aspect ratio of 22. The tabular grain population made up 80% of the total projected area of the emulsion grains.

EXAMPLE 6

AgIBr (3 mole % I) Tabular Grain Emulsion Made Using a Cationic Corn Starch

This emulsion was prepared similarly to Example 2, except that the emulsion was precipitated at pH 6.0, and the starch used was a cationic waxy corn starch (STA-LOK® 180, obtained from A. E. Staley Manufacturing Co.) made up of 100% amylopectin derivatized to contain 0.36 wt % nitrogen in the form of a quaternary trimethyl ammonium alkyl, starch ether and 0.06 wt % phosphorus, average molecular weight 324,000.

The tabular grain population of the resulting emulsion was comprised of tabular grains with an average equivalent circular diameter of 1.6 μm, an average thickness of 0.06 μm, and an average aspect ratio of 27. The tabular grain population made up 91% of the total projected area of the emulsion grains.

EXAMPLE 7

AgBr Tabular Grain Emulsion Made by Adding 94% of a Cationic Potato Starch After Grain Nucleation A starch solution was prepared by boiling for 30 min a stirred 200 g aqueous mixture containing 3.75 mmoles of NaBr and 8.0 g of the cationic potato starch STA-LOK® 400.

To a vigorously stirred reaction vessel of 12.5 g of the starch solution (0.5 g starch), 387.5 g distilled water, and 2.2 mmole of NaBr at pH of 6.0 and 35° C. was added 2M $AgNO_3$ solution at a constant rate of 10 mL per min. Concurrently, a 2.5M NaBr solution was added initially at 10 mL per min and then at a rate needed to maintain a pBr of 2.21. After 0.2 min, the addition of the solutions was stopped, 2.5 mL of 2M NaBr was added rapidly, and the temperature of the contents of the reaction vessel was increased to 60° C. at a rate of 5° C. per 3 min. At 60° C., 187.5 g of the starch solution (7.5 g starch) was added, the pH was adjusted to 6.0 and maintained at this value throughout the remainder of the precipitation, and the $AgNO_3$ solution was added at 1.0 mL per min for 3 min and the NaBr solution was concurrently added at a rate needed to maintain a pBr of 1.76. Then the addition of the NaBr solution was stopped but the addition of the $AgNO_3$ solution was continued at 1.0 mL per min until a pBr of 2.00 was obtained. Then the addition of the $AgNO_3$ was accelerated at 0.05 mL per min squared and the NaBr solution was added as needed to maintain a pBr of 2.00 until a total of 0.20 mole of silver had been added.

The tabular grain population of the resulting emulsion was comprised of tabular grains with an average equivalent circular diameter of 1.0 μm, an average thickness of 0.055 μm, and an average aspect ratio of 18. The tabular grain population made up 90% of the total projected area of the emulsion grains.

EXAMPLE 8

AgIBr (3 mole % I) Tabular Grain Emulsion Made Using a Cationic Amphoteric Corn Starch This emulsion was prepared similarly to Example 2, except that the starch used was a cationic amphoteric corn starch (STA-LOK® 356, obtained from A. E. Staley Manufacturing Co.) containing both a quaternary trimethyl ammonium alkyl starch ether (0.34 wt % nitrogen) and orthophosphate (1.15 wt % phosphorus) substituents. The cationic amphoteric starch was a mixture of 28% amylose and 72% amylopectin, with an average molecular weight of 486,000.

The tabular grain population of the resulting emulsion was comprised of tabular grains with an average equivalent circular diameter of 1.6 μm, an average thickness of 0.07 μm, and an average aspect ratio of 23. The tabular grain population made up 80% of the total projected area of the emulsion grains.

EXAMPLE 9

AgBr Tabular Grain Emulsion Made Using a Cationic Potato Starch

To a vigorously stirred reaction vessel containing 400 g of a solution at 35° C., pH 6.0 of 8.0 g cationic potato starch (STA-LOK® 400) and 6.75 mmolar in NaBr was added a 2M $AgNO_3$ solution at a rate of 10 mL per min. Concurrently, a 2M NaBr solution was added initially at 10 mL per min and then at a rate needed to maintain a pBr of 2.21. After 0.2 min., the addition of the solutions was Stopped, 2.5 mL of 2M NaBr was added rapidly and the temperature was increased to 60° C. at a rate of 5° C. per 3 min. At 60° C., the $AgNO_3$ solution was added at 1.0 mL per min for 1 min then its addition rate was accelerated to 5 mL per min in 30 min then held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 2.2 μm, an average thickness of 0.08 μm, and an average aspect ratio of 28. The tabular grain population made up 85% of the total projected area of the emulsion grains.

EXAMPLE 10

AgIBr (3 mole % I) Tabular Grain Emulsion Made Using a Protonated Tertiary Aminoalkyl (Cationic) Corn Starch This emulsion was prepared similarly to Example 2, except that the starch used was a corn starch (CATO-SIZE® 69, obtained from National Starch and Chemical Co.) that, as obtained, was derivatized to contain tertiary aminoalkyl starch ethers, 0.25 wt % nitrogen, 0.06 wt % phosphorus. At a pH of 5.5, the tertiary amino groups were protonated to render the starch cationic.

The tabular grain population of the resulting emulsion was comprised of tabular grains with an average equivalent circular diameter of 1.2 μm, an average thickness of 0.08 μm, and an average aspect ratio of 15. The tabular grain population made up 55% of the total projected area of the emulsion grains.

EXAMPLE 11

AgIBr (3 mole % I) Tabular Grain Emulsion Made Using a Cationic Potato Starch and at pH 5.5 and 80° C.

This emulsion was prepared similarly to Example 2, except that the starch used was cationic potato starch (STA-LOK® 400) and the temperature was increased to 80° C. (instead of 60° C.).

The tabular grain population of the emulsion was comprised of tabular grains with an average equivalent circular diameter of 1.7 μm, an average thickness of 0.07 μm, and an average aspect ratio of 24. The tabular grain population made up 80% of the total projected area of the emulsion grains.

EXAMPLE 12

AgIBr (3 mole % I) Tabular Grain Emulsion Made Using a Cationic Corn Starch

This emulsion was prepared similarly to Example 2, except that the starch used was a cationic corn starch (CATO® 25, obtained from National Starch and Chemical Company) containing 0.26 wt % nitrogen and 0.00 wt % phosphorus.

The tabular grain population of the resulting emulsion was comprised of tabular grains with an average equivalent circular diameter of 1.2 μm, an average thickness of 0.07 μm, and an average aspect ratio of 17. The tabular grain population made up 65% of the total projected area of the emulsion grains.

EXAMPLE 13

AgIBr (3 mole % I) Tabular Grain Emulsion Made Using a Cationic Corn Starch

This emulsion was prepared similarly to Example 2, except that the starch used was a cationic corn starch (Clinton 788®, obtained from ADM Corn Processing, Clinton, Iowa) containing 0.15 wt % nitrogen and 0.00 wt % phosphorus.

The tabular grain population of the resulting emulsion was comprised of tabular grains with an average equivalent circular diameter of 1.0 μm, an average thickness of 0.08 μm, and an average aspect ratio of 13. The tabular grain population made up 60% of the total projected area of the emulsion grains.

EXAMPLE 14

AgIBr (3 mole % I) Tabular Grain Emulsion Made Using a Cationic Wheat Starch

This emulsion was prepared similarly to Example 2, except that the starch used was a cationic wheat starch (K-MEGA® 53S, obtained from ADM/Ogilvie, Montreal, Quebec, Canada), which, as received was derivatized with a quaternary amine. The degree of substitution is 0.050 corresponding to 0.41 wt % nitrogen. The phosphorus was determined spectrophotometrically to be 0.07 wt %.

The tabular grain population of the resulting emulsion was comprised of tabular grains with an average equivalent circular diameter of 1.5 μm, an average thickness of 0.08 μm, and an average aspect ratio of 19. The tabular grain population made up 85% of the total projected area of the emulsion grains.

EXAMPLE 15

AgBr Tabular Grain Emulsion Made Using a Cationic Potato Starch

A starch solution was prepared by boiling for 30 min a stirred 400 g aqueous mixture containing 2.7 mmoles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 50° C. at a rate of 5° C. per 3 min. At 50° C., the pH was adjusted to 6.0 and the $AgNO_3$ solution was added at 1.0 mL per min for 1 min, then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.2 μm, an average thickness of 0.10 μm, and an average aspect ratio of 12. The tabular grain population made up 70% of the total projected area of the emulsion grains.

EXAMPLE 16

AgIBr (3 mole % I) Tabular Grain Emulsion Made Using a Cationic Potato Starch of High Nitrogen Content A cationic potato starch solution containing a high nitrogen content was supplied by Western Polymer Corporation. The starch was 1.10 wt % in nitrogen and 0.25 wt % in natural phosphorus.

To 40 g of the starch solution, which contained 8 g of starch, was added 360 g distilled water and 2.7 mmoles of NaBr. This solution was placed in a reaction vessel and used to precipitate this emulsion using the procedure described in Example 2.

The tabular grain population of the resulting emulsion was comprised of tabular grains with an average equivalent circular diameter of 1.2 μm, an average thickness of 0.09 μm, and an average aspect ratio of 13. The tabular grain population made up 80% of the total projected area of the emulsion grains.

EXAMPLE 17

AgBr Tabular Grain Emulsion Made Using a Cationic Potato Starch

A starch solution was prepared by boiling for 30 min a stirred 400 g aqueous mixture containing 2.7 moles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a salt solution of 2.5M NaBr was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the pH was adjusted to 6.0 and the $AgNO_3$ solution was added at 1.0 mL per min for 1 min then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76. Then the addition of the NaBr solution was stopped and the flow rate of the $AgNO_3$ solution was dropped to 1 mL per min. When the pBr reached 2.28, the NaBr solution flow was resumed to maintain this pBr. After 60 min of growth at this pBr, the pBr was adjusted to 3.04 and maintained at this value until a total of 0.53 moles of silver had been added.

The tabular grain population of the resulting emulsion was comprised of tabular grains with an average equivalent circular diameter of 2.0 μm, an average thickness of 0.14 μm, and an average aspect ratio of 14. The tabular grain population made up 85% of the total projected area of the emulsion grains.

CONTROL EXAMPLES 18 THROUGH 22

These examples demonstrate tabular grain preparation failures resulting from choosing noncationic starches as peptizers.

CONTROL EXAMPLE 18

AgIBr (3 mole % I) Nontabular Grain Emulsion Made Using a Water-Soluble Carboxylated (Noncationic) Corn Starch This emulsion was prepared similarly to Example 2, except that the starch used was a corn starch (FILMKOTE® 54, obtained from National Starch and Chemical Co.), which, as supplied, was derivatized to contain carboxylate groups. The nitrogen content was natural, 0.06 wt %.

A nontabular grain emulsion resulted.

CONTROL EXAMPLE 19

AgIBr (3 mole % I) Nontabular Grain Emulsion Made Using a Water-Soluble Orthophosphate Derivatized (Noncationic) Potato Starch This emulsion was prepared similarly to Example 2, except that the starch used was an orthophosphate derivatized potato starch 0.03 wt % nitrogen (natural), and orthophosphate substituents, 0.66 wt % phosphorus. The sample was obtained from Western Polymer Corporation.

A nontabular grain emulsion resulted.

CONTROL EXAMPLE 20

AgIBr (3 mole % I) Nontabular Grain Emulsion Made Using a Water-Soluble Hydroxypropyl-substituted (Noncationic) Corn Starch This emulsion was prepared similarly to Example 2, except that the starch (STARPOL® 530, was obtained from A. E. Staley Manufacturing Co.) used was a hydroxypropyl-substituted corn starch, 0.06 wt % nitrogen (natural) and 0.12 wt % phosphorus.

A nontabular grain emulsion resulted.

CONTROL EXAMPLE 21

AgIBr (3 mole % I) Nontabular Grain Emulsion Made Using a Water-Soluble (Noncationic) Potato Starch This emulsion was prepared similarly to Example 2, except that the starch (Soluble Potato Starch obtained from Sigma Chemical Company, St. Louis, Mo.) used was a treated and purified water soluble potato starch, 0.04 wt % nitrogen and 0.06 wt % phosphorus.

A nontabular grain emulsion resulted.

CONTROL EXAMPLE 22

AgIBr (3 mole % I) Nontabular Grain Emulsion Made Using a Water-Soluble (Noncationic) Wheat Starch This emulsion was prepared similarly to Example 2, except that the starch (Supergel® 1400, obtained from ADM/Ogilvie, Montreal, Quebec, Canada) used was a water soluble noncationic wheat starch.

A nontabular grain emulsion resulted.

CONTROL EXAMPLE 23

AgIBr (3 mole % I) Nontabular Grain Emulsion Made Using the Grain Protein Zein

This example demonstrates to the failure of the grain protein zein to act as a peptizer.

In a stirred reaction vessel, 8.0 g of zein (obtained from Sigma Chemical Co.) in 400 g distilled water containing 2.7 mmole of NaBr was boiled for 60 min. Most of the zein did not appear to dissolve. The mixture was filtered and the filtrate was used as the starch solution to precipitate silver halide using conditions similar to those used in Example 2.

The resulting precipitation resulted in large clumps of nontabular grains.

CONTROL EXAMPLES 24 THROUGH 27

These examples demonstrate tabular grain preparation failures resulting from choosing noncationic starch-like substances as peptizers.

CONTROL EXAMPLE 24

AgIBr (3 mole % I) Nontabular Grain Emulsion Made Using the Noncationic Polysaccharide Dextran This emulsion was prepared similarly to Example 2, except that the polysaccharide dextran (obtained from Sigma Chemical Co., St. Louis, Mo.), having a molecular weight of approximately 500,000, was employed.

The resulting precipitation resulted in large clumps of nontabular grains. Dextran was unable to peptize the silver halide grains.

CONTROL EXAMPLE 25

AgIBr (3 mole % I) Nontabular Grain Emulsion Made Using the Noncationic Polysaccharide, Agar This emulsion was prepared similarly to Example 2 except that the polysaccharide used was agar (purified, ash content <2%), obtained from Sigma Chemical Co.

The resulting precipitation resulted in large clumps and isolated nontabular grains. Agar was a poor peptizer for silver halide grains.

CONTROL EXAMPLE 26

AgIBr (3 mole % I) Nontabular Grain Emulsion Made Using the Noncationic Polysaccharide Pectin This emulsion was prepared similarly to Example 2, except that the polysaccharide used was pectin from citrus fruit (obtained from Sigma Chemical Co).

A nontabular grain emulsion resulted.

CONTROL EXAMPLE 27

AgIBr (3 mole % I) Nontabular Grain Emulsion Made Using the Noncationic Polysaccharide, Gum Arabic This emulsion was prepared similarly to Example 2, except that the polysaccharide used was gum arabic (obtained from Sigma Chemical Co.), having a molecular weight of about 250,000.

A nontabular grain emulsion resulted.

CONTROL EXAMPLES 28 THROUGH 30

These examples confirm that the experimental conditions demonstrated above to produce tabular grain emulsions with cationic starch worked poorly using gelatin. While gelatin is a well known peptizer for the precipitation of tabular grain emulsions, the choice of adding all of the peptizer before grain nucleation, demonstrated above using cationic starches, hampered tabular grain emulsion preparation.

CONTROL EXAMPLE 28

AgIBr (3 mole % I) Tabular Grain Emulsion Made Using Gelatin as Peptizer

This emulsion was prepared similarly to Example 2, except that oxidized bone gelatin was substituted for the starch.

The tabular grain population of the resulting emulsion was comprised of tabular grains with an average equivalent circular diameter of 2.2 μm, an average thickness of 0.07 μm, and an average aspect ratio of 31. The tabular grain population made up 60% of the total projected area of the emulsion grains, down from 85% in Example 2.

CONTROL EXAMPLE 20

AgIBr (3 mole % I) AgIBr Nontabular Grain Emulsion Made Using Gelatin as Peptizer This emulsion was prepared similarly to Control Example 28, except that precipitation was terminated after the addition of 0.1 mole of silver nitrate.

The tabular grain population of the resulting emulsion was comprised of tabular grains with an average equivalent circular diameter of 2.0 μm, an average thickness of 0.06 μm, and an average aspect ratio of 33. The tabular grain population made up only 30% of the total projected area of the emulsion grains.

CONTROL EXAMPLE 30

AgBr Nontabular Grain Emulsion Made Using Gelatin as Peptizer

This emulsion was prepared similarly to Example 2, except that oxidized bone gelatin was substituted for the starch and the precipitation growth temperature was 60° C., instead of 50° C.

The tabular grain population of the resulting emulsion was comprised of tabular grains with an average equivalent circular diameter of 3.2 μm, an average thickness of 0.07 μm, and an average aspect ratio of 46. The tabular grain population made up only 30% of the total projected area of the emulsion grains.

CONTROL EXAMPLE 31

AgIBr (2.7 mole % I) Tabular Grain Emulsion

This emulsion was prepared in bone gelatin using conventional techniques favorable for the formation of tabular grain emulsions for the purpose of providing an emulsion with tabular grain thicknesses equal to or less than and tabular grain projected areas equal to or greater than those of the tabular grain emulsion precipitated in cationic starch reported in Example 1.

The emulsion was diafiltered-washed to a pBr of 3.38 at 40° C. The tabular grains had an average equivalent circular diameter of 2.45 μm, an average thickness of 0.06 μm, and an average aspect ratio of 41. The tabular grain population made up 95% of the total projected area of the emulsion grains.

TABLE I

Emulsion Summary

| Example (Control) | Peptizer | Cationic | Wt % Nitrogen | Wt % Phosphorus | Tabular Grains Present | Tabular Grains as % of Total Grain Projected Area |
|---|---|---|---|---|---|---|
| 1 | Potato Starch | Yes | 0.33 | 0.13[a] | Yes | 92 |
| 2 | Hybrd Corn S. | Yes | 0.31 | 0.00 | Yes | 85 |
| 3 | Potato Starch | Yes | 0.36 | 0.70 | Yes | 95 |
| 4 | Potato Starch | Yes | 0.36 | 0.70 | Yes | 95 |
| 5 | Potato Starch | Yes | 0.33 | 0.13[a] | Yes | 80 |
| 6 | Waxy Corn S. | Yes | 0.36 | 0.06[a] | Yes | 91 |
| 7 | Potato Starch | Yes | 0.33 | 0.13[a] | Yes | 90 |
| 8 | Potato Starch | Yes | 0.34 | 1.15 | Yes | 80 |
| 9 | Potato Starch | Yes | 0.33 | 0.13[a] | Yes | 85 |
| 10 | Corn Starch | Yes | 0.25 | 0.03[a] | Yes | 55 |
| 11 | Potato Starch | Yes | 0.33 | 0.13[a] | Yes | 80 |
| 12 | Corn Starch | Yes | 0.26 | 0.00 | Yes | 65 |
| 13 | Corn Starch | Yes | 0.15 | 0.00 | Yes | 60 |
| 14 | Wheat Starch | Yes | 0.41[b] | 0.07[a] | Yes | 85 |
| 15 | Potato Starch | Yes | 0.33 | 0.13[a] | Yes | 70 |
| 16 | Potato Starch | Yes | 1.10 | 0.25[a] | Yes | 80 |
| 17 | Potato Starch | Yes | 0.33 | 0.13[a] | Yes | 85 |
| (18) | Corn Starch | No | 0.06[a] | 0.00 | No | 0 |
| (19) | Potato Starch | No | 0.03[a] | 0.66 | No | 0 |
| (20) | Corn Starch | No | 0.06[a] | 0.00 | No | 0 |
| (21) | Potato Starch | No | 0.04[a] | 0.06 | No | 0 |
| (22) | Wheat Starch | No | NM | NM | No | 0 |
| (23) | Zein | No | NM | NM | No | 0 |
| (24) | Dextran | No | NM | NM | No | 0 |
| (25) | Agar | No | NM | NM | No | 0 |
| (26) | Pectin | No | NM | NM | No | 0 |
| (27) | Gum Arabic | No | NM | NM | No | 0 |
| (28) | Gelatin | NA | NA | NA | Yes | 60 |
| (29) | Gelatin | NA | NA | NA | Yes | 30 |
| (30) | Gelatin | NA | NA | NA | Yes | 30 |
| (31) | Gelatin | NA | NA | NA | Yes | 95 |

[a]Natural content
[b]Calculated from the degree of substitution.
NM = Not Measured
NA = Not Applicable

EXAMPLE 32

Photographic Comparisons

Four emulsion samples were compared.

The tabular grain emulsion of Example 1, precipitated in the presence of cationic starch, was divided into three portions to form three samples. Two portions received no further treatment Until sensitization, "Example 1 STA" and "Example 1 STA-Spectral". The samples were identical, but the latter sample received only spectral sensitization, instead of chemical and spectral sensitization, as in the case of the remaining emulsion samples.

To 0.81 mole of the third portion, "Example 1 GEL", 20 g of bone gelatin in 100 mL distilled water were added. The purpose of adding gelatin was to demonstrate the effect of gelatin added as a vehicle after precipitation and before chemical sensitization, as is conventional practice.

A fourth emulsion sample was taken from a conventional silver iodobromide (2.7 mole % I) tabular grain precipitated in bone gelatin, Control Example 31. The purpose of providing this sample was to compare the properties of an emulsion precipitated in gelatin to the emulsions precipitated in the absence of gelatin and sensitized either in the presence or absence of gelatin.

To 0.035 mole of the emulsion sample (see Table II, below) at 40° C., with stirring, were added sequentially the following solutions containing (mmole/mole Ag); 2.5 of NaSCN, 0.22 of a benzothiazolium salt, 1.5 of anhydro-5, 5-'dichloro-3,3'-bis(3-sulfopropyl)thiacyanine hydroxide, triethylammonium salt, and 0.08 of 1-(3-acetamidophenyl)-5-mercaptotetrazole, sodium salt. The pH was adjusted to 5.9. Then the following solutions were sequentially added (mmole/mole Ag) 0.023 of 2-propargylaminobenzoxazole, 0.036 of 1,3-dicarboxymethyl-1,3-dimethyl-2-thiourea, and 0.014 of bis(1,3,5-trimethyl-1,2,4-triazolium-3-thiolate) gold (I) tetrafluoroborate. The mixture was heated to 55° C. at a rate of 5° C./3 min, and held at 55° C. for 15 min. Upon cooling to 40° C., a solution of 1.68 of 5-bromo-4-hydroxy-6-methyl-1,3,3a,7-tetraazaindene was added. Example 1 STA-Spectral only had the spectral sensitizing dye added.

The resulting sensitized emulsions were mixed with gelatin, yellow dye-forming coupler dispersion, surfactants, and hardener and coated onto clear support at 0.84 g/m$^2$ silver, 1.7 g/m$^2$ yellow dye-forming coupler, and 3.5 g/m$^2$ bone gelatin.

The coatings were exposed to blue light for 0.02 sec through a 0 to 4.0 log density graduated step tablet, processed in the Kodak Flexicolor C-41™ Color negative process using a development time of 3 min 15 sec.

The results are summarized in Table II.

TABLE II

| Emulsion Sensitized | $D_{max}$ | $D_{min}$ | Mid-Scale Contrast | Relative Speed at 0.2 above Dmin |
|---|---|---|---|---|
| Control Example 31 | 3.03 | 0.08 | 2.01 | 100 |
| Example 1 GEL | 2.86 | 0.09 | 1.79 | 115 |
| Example 1 STA | 3.18 | 0.13 | 2.08 | 204 |
| Example 1 STA-Spectral | 0.70 | 0.05 | 1.69 | −11 |

Control Example 31, a conventional tabular grain emulsion in which the grains were precipitated in gelatin, was employed as the speed reference. Example 1 GEL, which was precipitated in cationic starch, but had gelatin added before chemical sensitization, exhibited a speed that was 15 relative speed units faster than the speed of Control Example 31. Thus, Example 1 GEL was 0.15 log E (15 relative speed units=0.15 log E, where E is exposure in lux-seconds) faster than Control Example 31. This amounted to a speed advantage of (one-half stop). It was unexpected that precipitation in cationic starch as opposed to gelatin would produce this significant speed advantage.

Quite surprising was the large speed advantage demonstrated by Example STA. This emulsion, which precipitated and sensitized in the absence of gelatin, was 1.04 log E faster than Control Example 31. In other words, it was more than 10 times faster than the conventional Control Example 31 emulsion.

Example 1 STA-Spectral was included to demonstrate that the cationic starch itself, apart from the chemical sensitizers, was not imparting the speed observed. Example 1 STA-Spectral was 111 relative speed units (1.11 log E) slower than Control Example 31. From this it was concluded that the cationic starch was in some way permitting better interaction of the chemical sensitizer with the grain surface than is conventionally realized by employing gelatin as a peptizer.

EXAMPLE 33

Testing for Starch Retained after Washing

A coating of Example 1 STA prepared as described in Example 32 was treated with a 0.2 wt % solution of active proteolytic enzyme (H.T.-Proteolytic 200 from Miles Labs, Inc., Elkhart, Ind.) for 30 min at 35° C. to degrade the gelatin. The emulsion grains were washed twice in distilled water and examined by infrared spectroscopy. The infra-red absorption spectrum of the starch was clearly observed, demonstrating that the starch remained a permanent part of the emulsion and was not removed by washing.

EXAMPLE 34

Peptizer Viscosity Comparisons

CS

A 2 percent by weight cationic starch solution, CS, was prepared by boiling for 30 min a stirred mixture of 8 g STA-LOK® 400, 2.7 mmoles of NaBr and distilled water to 400 mL. The solution was sonicated for 3 min. The resulting solution was cooled to 40° C., readjusted to 400 mL with distilled water, sonicated for 3 min, and the pH adjusted to 6.0.

GEL

A 2 percent by weight gelatin solution, GEL, was prepared using bone gelatin. To 4 L was added 27 mmoles of NaBr and the pH was adjusted to 6.0 at 40° C.

The kinematic viscosities of water and the CS and GEL solutions were measured at various temperatures. The results are given below.

TABLE III

| | Viscosity (cP) | | |
|---|---|---|---|
| | Temperature | | |
| Solution | 40° C. | 20° C. | 11° C. |
| Water | 0.66 | 1.00 | 1.27 |
| CS | 3.55 | 5.71 | 7.39 |
| GEL | 1.67 | X | X |

X = Could not be run because the solution solidified.

The viscosity data show that cationic starch has low viscosity at low temperatures while the gelatin solution solidified. This makes cationic starch particularly useful for silver halide grain nucleation and/or growth at temperatures below 25° C.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains including tabular grains (a) having {111} major faces, (b) containing greater than 50 mole percent bromide, based on silver, (c) accounting for greater than 50 percent of total grain projected area, and (d) having a thickness in the range of from at least 0.07 to 0.3 μm, and a dispersing medium including a peptizer adsorbed to the silver halide grains, wherein the peptizer is a water dispersible cationic starch.

2. A radiation-sensitive emulsion according to claim 1 wherein the cationic starch is comprised of α-amylose.

3. A radiation-sensitive emulsion according to claim 1 wherein the cationic starch is comprised of amylopectin.

4. A radiation-sensitive emulsion according to claim 1 wherein the starch contains cationic moieties selected from among protonated amine moieties and quaternary ammonium, sulfonium and phosphonium moieties.

5. A radiation-sensitive emulsion according to claim 1 wherein the cationic starch contains α-D-glucopyranose repeating units having 1 and 4 position linkages.

6. A radiation-sensitive emulsion according to claim 5 wherein the cationic starch additionally contains 6 position linkages in a portion of the glucopyranose repeating units to form a branched chain polymeric structure.

7. A radiation-sensitive emulsion according to claim 1 wherein the cationic starch is dispersed to at least a colloidal level of dispersion.

8. A radiation-sensitive emulsion according to claim 7 wherein the cationic starch is at least in part present as an aqueous solute.

9. A radiation-sensitive emulsion according to claim 1 wherein the peptizer consists essentially of the cationic starch.

10. A radiation-sensitive emulsion according to claim 9 wherein the tabular grains are chemically sensitized.

11. A radiation-sensitive emulsion according to claim 10 wherein the tabular grains are chemically sensitized with at least one of sulfur, gold and reduction sensitizers.

12. A radiation-sensitive emulsion according to claim 10 wherein a photographic vehicle is combined with the chemically sensitized tabular grains.

13. A radiation-sensitive emulsion according to claim 12 wherein the photographic vehicle includes gelatin or a gelatin derivative.

* * * * *